US005107863A

United States Patent [19]

Nyffeler et al.

[11] Patent Number: 5,107,863

[45] Date of Patent: Apr. 28, 1992

[54] CIGARETTE AND FILTER THEREFOR

[75] Inventors: Urs Nyffeler, Cormondreche; Roger S. Slagle, Cressier; Andreas Stathopoulos, Epalinges, all of Switzerland

[73] Assignee: Fabriques de Tabac Reunies, S.A., Neuchatel, Switzerland

[21] Appl. No.: 508,933

[22] Filed: Apr. 12, 1990

[30] Foreign Application Priority Data

Apr. 14, 1989 [GB] United Kingdom ..... 8908535
Aug. 24, 1989 [EP] European Pat. Off. ..... 89308624

[51] Int. Cl.[5] ..... A24D 3/04

[52] U.S. Cl. ..... 131/338; 131/339; 131/340

[58] Field of Search ..... 131/331, 339, 340, 345, 131/344

[56] References Cited

U.S. PATENT DOCUMENTS 4,026,306 5/1977 Berger .
4,034,765 7/1977 Hall .
4,088,065 5/1978 Hall .
4,291,711 9/1981 Berger ..... 131/331
4,355,995 10/1982 Berger .
4,357,950 11/1982 Berger .
4,498,488 2/1985 Johnson .
4,508,525 4/1985 Berger .
4,768,526 9/1988 Pryor .
4,776,354 10/1988 Norman et al. .
4,874,004 10/1989 Borowski et al. .

FOREIGN PATENT DOCUMENTS 3638801 5/1987 Fed. Rep. of Germany .
2113066 8/1983 United Kingdom .
2119221 11/1983 United Kingdom .
2183138 6/1987 United Kingdom .

OTHER PUBLICATIONS

"The Design of Cigarettes" by Browne Second Edition 1981 by Celanese Corporation pp. 40–46.

*Primary Examiner*—V. Millin
*Attorney, Agent, or Firm*—Jeffrey H. Ingerman

[57] ABSTRACT

A cigarette filter 12 comprises a rod of filter material having an inner zone 16 of 60% to 90% filter efficiency and an outer zone 18 of 10% to 40% filter efficiency, the inner zone occupying from 30% to 60% of the cross-sectional area of the filter. The filter is attached to a tobacco rod 10 by a tipping 14 having perforations 24 admitting air into the filter.

11 Claims, 1 Drawing Sheet

CIGARETTE AND FILTER THEREFOR

Figure 1:
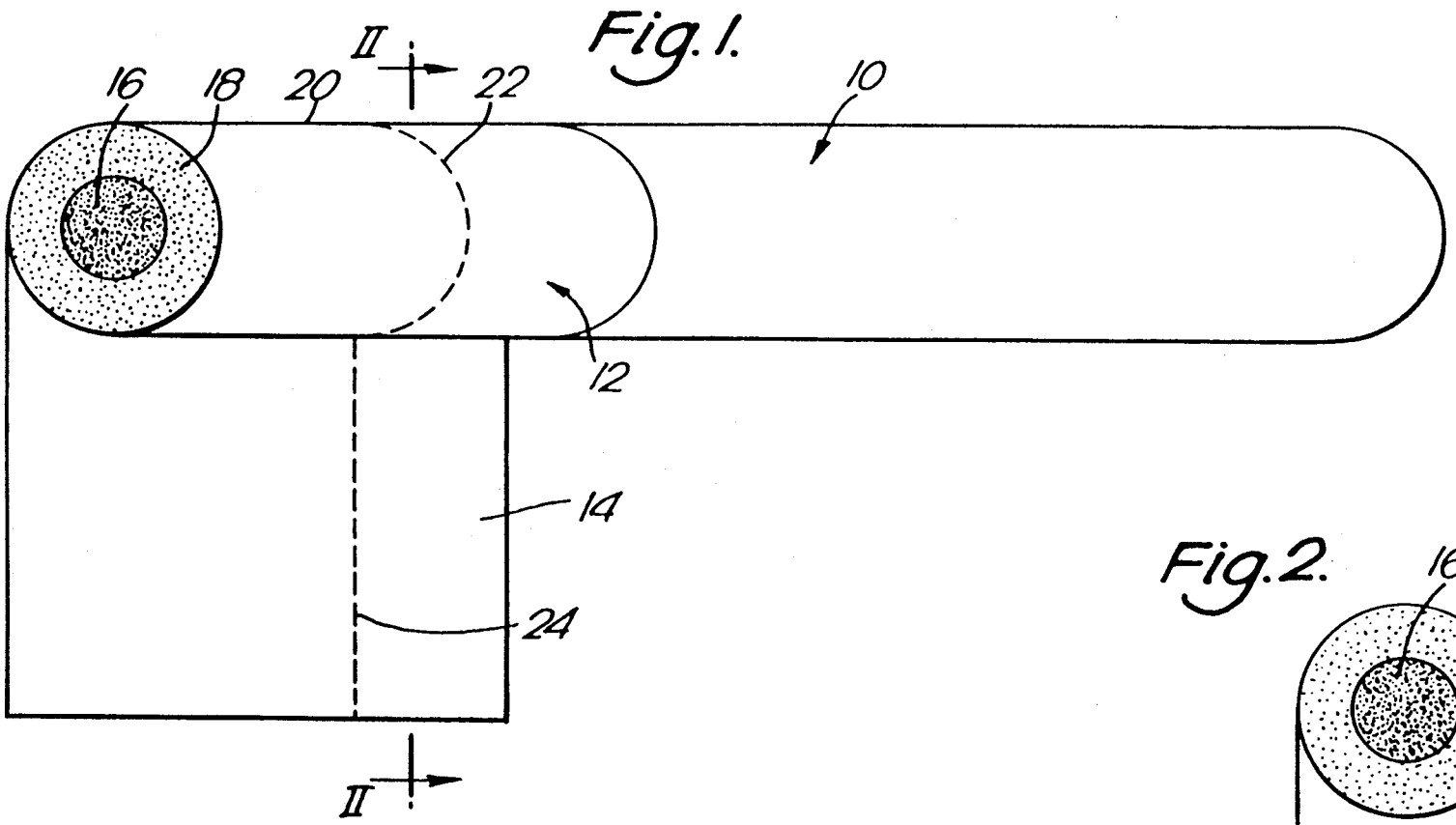

The present invention relates to filter cigarettes and to filters for use in such cigarettes.

It is an object to provide a filter and a cigarette incorporating the filter, whereby smokers can derive an enhanced subjective impression from cigarettes of reduced tar delivery.

In accordance with this invention a cigarette filter comprises a rod of filter material having a longitundinal inner zone of 60 to 90% filter efficiency and a peripheral outer zone of 10 to 40% filter efficiency, the inner zone occupying from 30 to 60% of the cross-sectional area of the filter rod.

Although such filters without provision for the admission of ventilating air are contemplated, the advantageous effect is further enhanced by ventilation. The filter rod may have an impermeable peripheral surface layer or be surrounded by a wrapper, which may be of permeable or impermeable material. Moreover, in use the rod will be surrounded by tipping material which serves to secure the filter to a rod of smoking material such as tobacco. To provide ventilation, the tipping material, as well as the filter wrapper or peripheral surface layer where these are present, should have one or more permeable regions which in normal smoking admit air in an amount corresponding to from 10 to 90% and more especially 20 to 80% ventilation.

The cigarette according to the invention comprises a filter as described abutting coaxially and secured to a rod of smoking material, and has a puff count of not less than 6.

The advantages of the invention are particularly striking when the filter is longer in relation to the rod of smoking material than in conventional cigarettes. It is preferred in this case to employ a relatively slow burning tobacco blend in the cigarette.

The filter preferably occupies from 25 to 50% of the total length of the cigarette. Preferred filters are from 27 to 42 mm long.

The preferred tobacco rod has a length between 40 and 60 mm, and provides a cigarette having a puff count of between 6 and 10.

Figure 2:
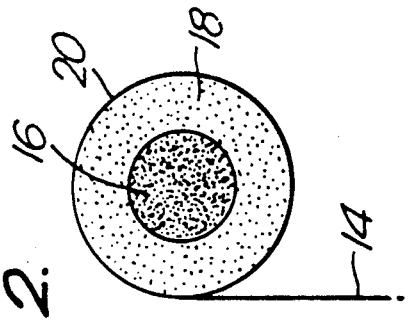

The invention will be further described, by way of example, with reference to the drawings, in which:

FIG. 1 shows diagrammatically a cigarette according to a preferred embodiment of the invention; and FIG. 2 shows a cross section on lne II—II of FIG. 1.

The cigarette of FIG. 1 comprises a wrapped tobacco rod 10 and a filter 12. The filter 12 is attached in conventional manner to the tobacco rod 10 by tipping 14, which is shown partially removed in the figures.

The filter 12 comprises an inner, longitudinally extending, filter zone 16 of high total particulate matter (TPM) filtration efficiency filter material and a peripheral filter zone 18 of lower TPM filtration efficiency filter material. Both zones extend from the mouth end to the tobacco rod end of the filter 12. The outer peripheral surface of the filter 12 is rendered impervious to air and smoke by a wrapper 20.

Perforations 22 in the wrapper 20 and corresponding perforations 24 in the tipping 14 are provided for admission of ventilating air to the peripheral filter zone 18 during smoking.

The specification of the preferred cigarette shown in the drawings is as follows:

| | |
|---|---|
| Cigarette length | 84 mm |
| Cigarette diameter | 7.9 mm |
| Filter: | |
| length | 33 mm |
| pressure drop | 100 mm $H_2O$ |
| inner zone diameter | 5 mm |
| inner zone composition | Y-section cellulose acetate acetate tow, 3.0 denier per fibre, 35 000 total denier |
| peripheral zone composition | Y-section cellulose tow, 5.5 denier per fibre, 22 000 total denier. |
| ventilation level | 45% |
| overall filtration efficiency | 60% |
| Tobacco rod: | |
| length | 51 mm |
| tobacco weight | 625 mg |

This cigarette has the following characteristics:

| | |
|---|---|
| TPM delivery | 7.0 mg |
| nicotine delivery | 0.6 mg |
| carbon monoxide delivery | 8.0 mg |
| puff count | 8 |

It is found that the cigarette, and other cigarettes according to the invention, provide the smoker with a surprisingly enhanced subjective flavour response compared with conventional cigarettes of comparable deliveries having unitary filters.

Whilst not wishing to be bound by any theoretical explanation, it is postulated that the enhanced flavour effect is achieved because of the combination of high velocity flow through the peripheral filter zone 18, which is enhanced by ventilation of the zone, and low velocity flow through the high efficiency inner filter zone 16.

A high proportion of the TPM aerosol is channeled at relatively high velocity through the peripheral filter zone 18, since the relatively high density and low flow velocity through the inner filter zone 16 prevent a significant proportion passing through the inner zone.

This is in contrast to conventionally filtered smoke, which passes almost wholly through the central zone of the filter, since flow velocity is uniform across the filter, and ventilating air channels the aerosol to the centre.

The high velocity peripheral flow of the smoke through the filters of the invention is believed to leave in the smoke a higher than expected proportion of the components responsible for the flavour of the smoke, as distinct from the less volatile components. Thus, a smoke of enhanced flavour leaves the filter into the smoker's mouth.

Filters and cigarettes according to the invention provide a means whereby smokers can derive an enhanced subjective impression, normally associated with cigarettes of a relatively high TPM delivery, from a cigarette of relatively low TPM delivery.

We claim:

1. A cigarette filter comprising a rod of fibrous tow filter material having a longitudinally extending inner zone of 60 to 90% TPM filtration efficiency and a peripheral outer zone of 10 to 40% TPM filtration efficiency, the inner zone occupying from 30 to 60% of the cross-sectional area of the filter rod.

2. A filter according to claim 1 surrounded by a wrapper or tipping having one or more permeable regions adapted to admit ventilating air to the filter rod.

3. A filter according to claim 1 having an inner zone of diameter from 4.5 to 6 mm.

4. A filter according claim 1 having an axial length of 27 to 42 mm.

5. A filter according to any preceding claim having an overall TPM filtration efficiency of not less than 50%.

6. A filter cigarette comprising a rod of tobacco or other smoking material and a filter rod according to any one of claim 1, 2, 3 or 4 coaxially abutting and secured to the rod of smoking material, the cigarette having a puff count of not less than 6.

7. A cigarette according to claim 6 in which the length of the filter is from 25 to 50% of the overall length of the cigarette.

8. A cigarette according to claim 6 in which the length of the filter is from 27 to 42 mm.

9. A cigarette according to claim 6 having provision for the admission of ventilating air to the filter rod in an amount corresponding to from 10 to 90% ventilation in normal smoking.

10. A cigarette according to claim 6 in which the rod of smoking material has a length between 40 and 60 mm and the cigarette has a puff count from 6 to 10.

11. A filter cigarette according to claim 6 in which the filter has an overall TPM filtration efficiency of not less than 50%.

* * * * *